US010943466B2

(12) United States Patent
Rodriguez

(10) Patent No.: US 10,943,466 B2
(45) Date of Patent: Mar. 9, 2021

(54) SMOKE DETECTOR WITH INTEGRATED VAPORIZER FOR EXECUTING SELF-TESTING

(71) Applicant: CARRIER CORPORATION, Palm Beach Gardens, FL (US)

(72) Inventor: Jairo Munoz Rodriguez, Barcelona (ES)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/781,686

(22) Filed: Feb. 4, 2020

(65) Prior Publication Data

US 2020/0250963 A1 Aug. 6, 2020

(30) Foreign Application Priority Data

Feb. 4, 2019 (EP) ..... 19382080

(51) Int. Cl.
*G08B 29/00* (2006.01)
*G08B 29/04* (2006.01)
*G08B 17/10* (2006.01)

(52) U.S. Cl.
CPC ..... *G08B 29/043* (2013.01); *G08B 17/10* (2013.01)

(58) Field of Classification Search
CPC ..... G08B 29/043; G08B 19/00
USPC ..... 340/514, 522, 627, 630, 870.01
See application file for complete search history.

(56) References Cited

U.S. PATENT DOCUMENTS 10,803,732 B2 * 10/2020 Penney ..... G08B 29/145
2012/0092175 A1 * 4/2012 Adams ..... G08B 17/117 340/627

FOREIGN PATENT DOCUMENTS

GB 2543065 A 4/2017
WO 2015162530 A1 10/2015

OTHER PUBLICATIONS

European Patent Office, Extended European Search Report, Application No. 19382080.0-1206, dated Aug. 9, 2019 (6 pp.).

* cited by examiner

*Primary Examiner* — Tai T Nguyen
(74) *Attorney, Agent, or Firm* — Cantor Colburn LLP

(57) ABSTRACT

Disclosed is a smoke detector having a controller configured for executing an operational test, the operational test including: activating an electronic vaporizer to produce vaporized particulate within the smoke detector; rendering a first determination of whether a particulate sensor disposed in the detector senses the vaporized particulate; and rendering a second determination based on the first determination, the second determination identifying an operational state of the smoke detector.

20 Claims, 2 Drawing Sheets

SMOKE DETECTOR WITH INTEGRATED VAPORIZER FOR EXECUTING SELF-TESTING

CROSS-REFERENCE TO RELATED APPLICATIONS

This application claims the benefit of European Patent Application No. 19382080.0, filed Feb. 4, 2019, the disclosure of which is incorporated herein by reference in its entirety.

BACKGROUND

Exemplary embodiments pertain to the art of smoke detectors and more specifically to a smoke detector with an integrated vaporizer for executing self-testing.

Manual tests of a smoke detector with smoke or aerosol may be periodically performed. A test of a smoke detector may be mandatory in some countries as part standard maintenance protocols to verify operation of the smoke detector.

BRIEF DESCRIPTION

Disclosed is a smoke detector comprising a controller configured for executing an operational test, the operational test including: activating an electronic vaporizer to produce vaporized particulate within the smoke detector; rendering a first determination of whether a particulate sensor disposed in the detector senses the vaporized particulate; and rendering a second determination based on the first determination, the second determination identifying an operational state of the smoke detector.

In addition to one or more of the above disclosed features or as an alternate the controller may perform the step of effecting a first communication with a monitoring panel that is in electronic communication with the smoke detector, the first communication identifying the operational state of the smoke detector.

In addition to one or more of the above disclosed features or as an alternate the second determination identifies the operational state as a fault state or a non-fault state.

In addition to one or more of the above disclosed features or as an alternate the controller is configured for effecting the first communication only when the second determination identifies that the operational state is a fault state.

In addition to one or more of the above disclosed features or as an alternate the controller is configured for periodically executing the operational test.

In addition to one or more of the above disclosed features or as an alternate the smoke detector may include an optical chamber within a housing, wherein the controller is configured for determining that the operational state is a non-fault state when the sensor senses vaporized particulate flowing into the optical chamber.

In addition to one or more of the above disclosed features or as an alternate the smoke detector may include a fluid cartridge within the housing, wherein the controller is configured for activating the vaporizer to vaporize fluid within the fluid cartridge, whereby vaporized particulate flows into the optical chamber.

In addition to one or more of the above disclosed features or as an alternate the controller is configured for determining when the fluid within the fluid cartridge is depleted.

In addition to one or more of the above disclosed features or as an alternate the controller and vaporizer are powered by a battery.

In addition to one or more of the above disclosed features or as an alternate the controller and vaporizer are powered by loop voltage.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
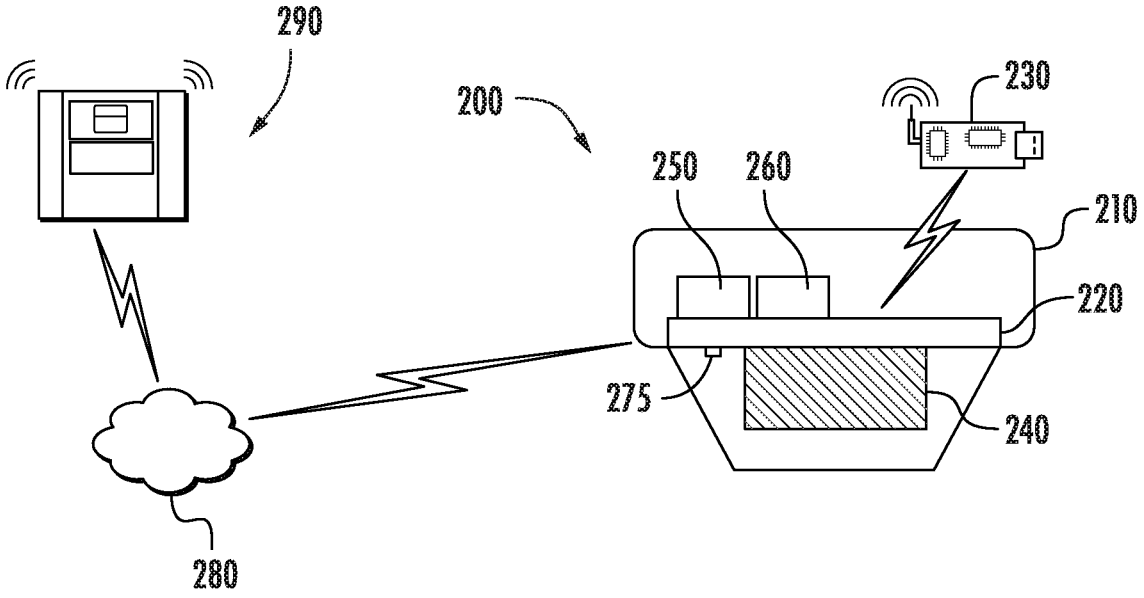
FIG. 1 illustrates a smoke detector according to an embodiment.
Figure 2:
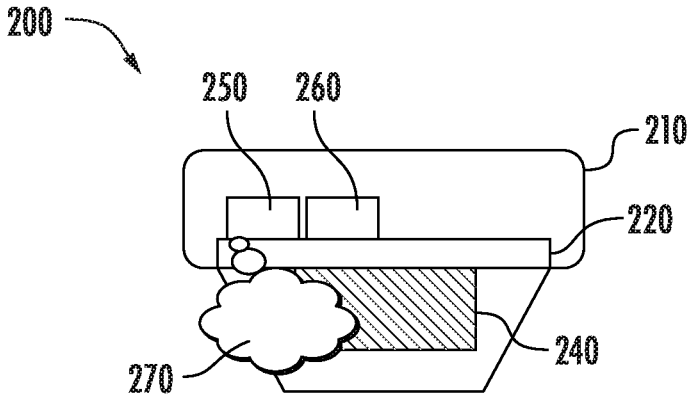
FIG. 2 illustrates a smoke detector according to an embodiment wherein the liquid stored therein is vaporized.

Turning to FIGS. 1 and 2, illustrated is a smoke detector 200. The smoke detector 200 may include a housing 210 having therein a controller 220, which may be printed circuit board, and a sensor 230 that may be a particulate sensor. The controller 220 may communicate with the sensor 230 to identify flowing particulate, such as smoke. The smoke detector 200 may include an optical chamber 240 in which the sensor 230 is directed for sensing particulate flow.

The smoke detector 200 may include a liquid cartridge 250 and a vaporizer/atomizer 260 for vaporizing liquid within the cartridge 250. A resulting vaporized flow 270 may flow into the chamber 240 through a nozzle 275 to enable the controller 220 to perform an operational test when an emergency condition is not occurring. The controller 220 may determine that the smoke detector 200 is in an operational state or non-fault state when the sensor 230 sense vaporized particulate in the optical chamber 240. The controller 220 may determine that the smoke detector 200 is in a non-operational state or fault state when the sensor 230 fails to sense vaporized particulate in the optical chamber 240. The controller 220 may communicate results of the operational test over a network 280 with a first system monitoring panel 290. According to an embodiment the controller 220 and vaporizer 250 are powered by a battery and/or alternatively a loop voltage.

Figure 3:
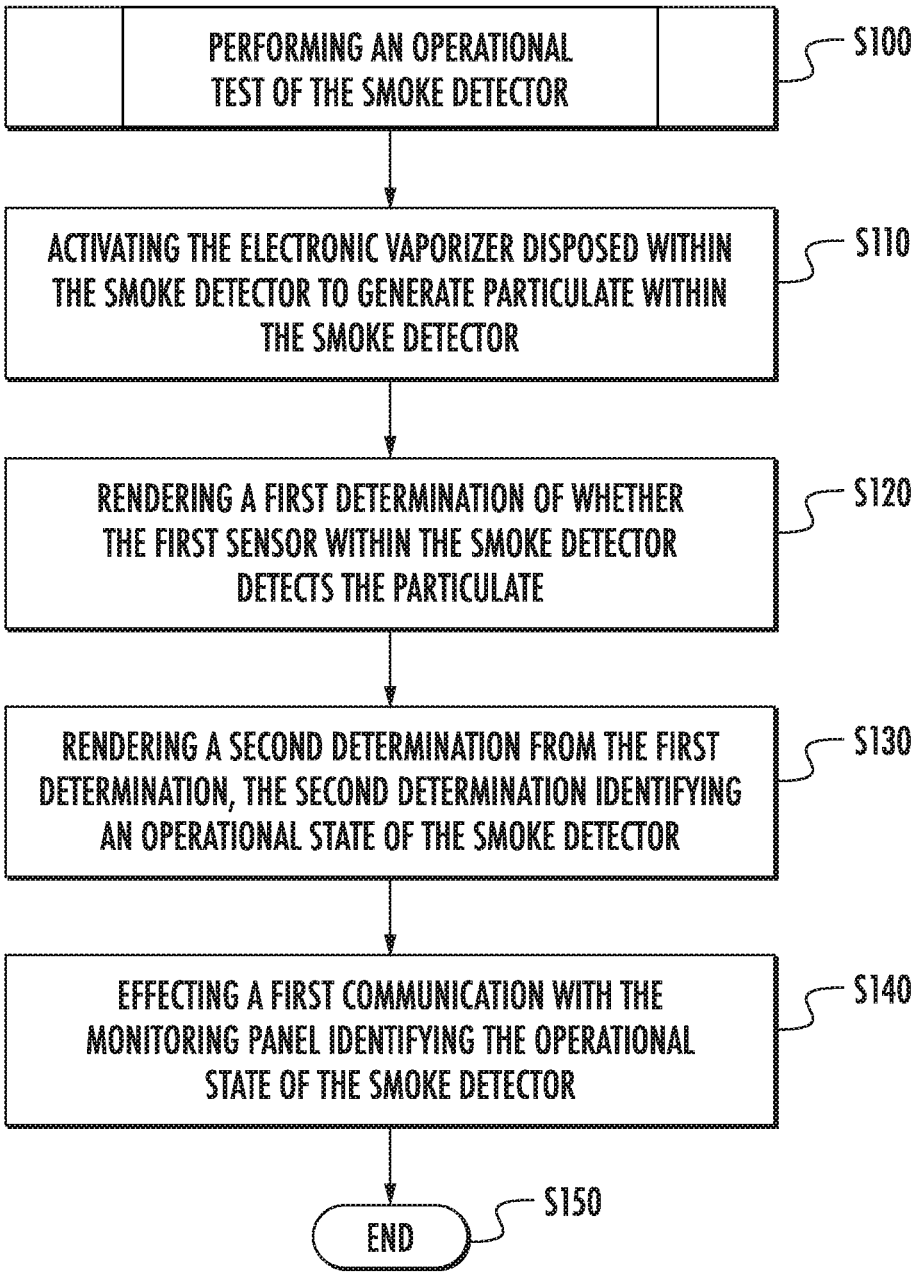
FIG. 3 illustrates a process of detecting an operational status executed by a smoke detector according to an embodiment.

Turning to FIG. 3, illustrated is a process S100 executed by the controller 220 of performing an operational test of the smoke detector 200. The operational test may include step S110 of activating the electronic vaporizer 260 disposed within the smoke detector 200 to generate particulate within the smoke detector 200. The controller 220 may be configured for executing step S120 of rendering a first determination of whether the sensor 230 within the smoke detector 200 detects the particulate. The controller 220 may be further configured for executing step S130 of rendering a second determination from the first determination, the second determination identifying an operational state of the smoke detector 200. Responsive to rendering the second determination, the controller 220 may be configured for executing step S140 of effecting a first communication with the monitoring panel 290 that is in electronic communication with the smoke detector 200. The first communication may identify the operational state of the smoke detector. Once the steps that began with process S100 has completed, the controller may terminate the process at step S150.

According to an embodiment the second determination may identify the operational state as a fault state or a non-fault state. According to an embodiment the controller 220 may be configured for effecting the first communication only when determining that the operational state is a fault state. Alternatively, the controller 220 may also effect the first communication when the operational state is a non-fault state, so that there may be an accounting of an operational state of all devices in a system. According to an embodiment the controller 220 may be configured for periodically executing the operational test, such as weekly, monthly or otherwise.

According to an embodiment, the controller 220 may register a number of operational tests performed to predict when the cartridge 250 has depleted the fluid and needs to be refilled or replaced. Such a determination may be based on counting a number of completed self-tests, such as ten self-tests if the cartridge 250 included enough liquid by volume to execute ten self-tests.

The above disclosed embodiments provide integrating an electronic vaporizer-atomizer into a smoke detector to create an aerosol from a liquid. Automatic self-tests of the detector may be performed by applying aerosol to simulate smoke conditions. Electronic vaporizing on an aerosol may be accomplished by using loop voltage in a powered detector or a battery within the self-powered detector. A controlled quantity of aerosol may be generated around a smoke chamber within the smoke detector to verify operation of the smoke detector.

Benefits of the disclosed embodiment may include a detector that may be programed for automatic self-testing and that may be able to identify a desired operational state or fault state after each test. Self-tests can be performed periodically, such as weekly or monthly. The detector and/or a fire monitoring panel may be able to indicate results of a test, for example, to identify a failed test, which may be reviewed by maintenance personnel. As a result, relatively early problem detection may be obtained automatically rather than, for example, manually, which may result in a savings in both time and resources.

Network protocols applied by devices disclosed herein may include typical loop protocols. It is within the scope of the disclosure to include local area network (LAN) protocols and/or private area network (PAN) protocols. LAN protocols may apply Wi-Fi technology, which is a technology based on the Section 802.11 standards from the Institute of Electrical and Electronics Engineers, or IEEE. PAN protocols include, for example, Bluetooth Low Energy (BTLE), which is a wireless technology standard designed and marketed by the Bluetooth Special Interest Group (SIG) for exchanging data over short distances using short-wavelength radio waves. PAN protocols may also include Zigbee, a technology based on Section 802.15.4 protocols from the Institute of Electrical and Electronics Engineers (IEEE). More specifically, Zigbee represents a suite of high-level communication protocols used to create personal area networks with small, low-power digital radios for low-power low-bandwidth needs, and is best suited for small scale projects using wireless connections. Wireless protocols may further include short range communication (SRC) protocols, which may be utilized with radio-frequency identification (RFID) technology. RFID may be used for communicating with an integrated chip (IC) on an RFID smartcard. Wireless protocols may further include long range, low powered wide area network (LoRa and LPWAN) protocols that enable low data rate communications to be made over long distances by sensors and actuators for machine-to-machine (M2M) and Internet of Things (IoT) applications.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A smoke detector comprising a controller configured for executing an operational test, the operational test including:

activating an electronic vaporizer to produce vaporized particulate within the smoke detector;

rendering a first determination of whether a particulate sensor disposed in the detector senses the vaporized particulate; and rendering a second determination based on the first determination, the second determination identifying an operational state of the smoke detector.

2. The smoke detector of claim 1, comprising effecting a first communication with a monitoring panel that is in electronic communication with the smoke detector, the first communication identifying the operational state of the smoke detector.

3. The smoke detector of claim 2, wherein the second determination identifies the operational state as a fault state or a non-fault state.

4. The smoke detector of claim 3, wherein the controller is configured for effecting the first communication only when the second determination identifies that the operational state is a fault state.

5. The smoked detector of claim 3, wherein the controller is configured for periodically executing the operational test.

6. The smoke detector of claim 5, comprising an optical chamber within a housing, wherein the controller is configured for determining that the operational state is a non-fault state when the sensor senses vaporized particulate flowing into the optical chamber.

7. The smoke detector of claim 6, comprising a fluid cartridge within the housing, wherein the controller is configured for activating the vaporizer to vaporize fluid within the fluid cartridge, whereby vaporized particulate flows into the optical chamber.

8. The smoke detector of claim 7, wherein the controller is configured for determining when the fluid within the fluid cartridge is depleted.

9. The smoke detector of claim 8, wherein the controller and vaporizer are powered by a battery.

10. The smoke detector of claim 9, wherein the controller and vaporizer are powered by loop voltage.

11. A method of executing an operational test for a smoke detector by a controller, the method comprising:

activating an electronic vaporizer to produce vaporized particulate within the smoke detector;

rendering a first determination of whether a particulate sensor disposed in the detector senses the vaporized particulate; and rendering a second determination based on the first determination, the second determination identifying an operational state of the smoke detector.

12. The method of claim 11, comprising effecting a first communication with a monitoring panel that is in electronic communication with the smoke detector, the first communication identifying the operational state of the smoke detector.

13. The method of claim 12, wherein the second determination identifies the operational state as a fault state or a non-fault state.

14. The method of claim 13, wherein the controller is configured for effecting the first communication only when the second determination identifies that the operational state is a fault state.

15. The method of claim 13, wherein the controller is configured for periodically executing the operational test.

16. The method of claim 15, comprising an optical chamber within a housing, wherein the controller is configured for determining that the operational state is a non-fault state when the sensor senses vaporized particulate flowing into the optical chamber.

17. The method of claim 16, comprising a fluid cartridge within the housing, wherein the controller is configured for activating the vaporizer to vaporize fluid within the fluid cartridge, whereby vaporized particulate flows into the optical chamber.

18. The method of claim 17, wherein the controller is configured for determining when the fluid within the fluid cartridge is depleted.

19. The method of claim 18, wherein the controller and vaporizer are powered by a battery.

20. The method of claim 19, wherein the controller and vaporizer are powered by loop voltage.

* * * * *